US005832639A

United States Patent [19]

Muncan

[11] Patent Number: 5,832,639

[45] Date of Patent: Nov. 10, 1998

[54] PORTABLE GARMENT FINISHING APPLIANCE

[76] Inventor: Peter Muncan, 15945 Sherman Way, #201, Van Nuys, Calif. 91406

[21] Appl. No.: 674,105

[22] Filed: Jul. 1, 1996

[51] Int. Cl.[6] ..... D06F 75/04

[52] U.S. Cl. ..... 38/77.6; 237/67

[58] Field of Search ..... 38/77.6, 77.9, 38/77.3, 85, 79, 82, 103, 104, 107; 223/70; 68/222; 122/11, 29, 508; 392/386, 394, 399; 237/67; 417/207, 208

[56] References Cited

U.S. PATENT DOCUMENTS

| | | | |
|---|---|---|---|
| 1,625,535 | 4/1927 | Graf . | |
| 1,629,553 | 5/1927 | Swenson . | |
| 1,660,396 | 2/1928 | Revill . | |
| 1,958,876 | 5/1934 | Wright | 38/77.6 |
| 2,137,387 | 11/1938 | Chapin | 38/77.6 |
| 2,160,421 | 5/1939 | Sebo . | |
| 2,815,593 | 12/1957 | Reimers et al. | 38/77.6 |
| 2,851,050 | 9/1958 | Cissell et al. | 38/77.6 X |
| 3,414,993 | 12/1968 | Naomoto | 38/77.6 |
| 3,436,852 | 4/1969 | Stansbury | 38/77.6 |
| 3,508,354 | 4/1970 | Stansbury et al. | 38/77.6 |
| 3,823,497 | 7/1974 | Solomon | 38/77.6 |
| 4,322,900 | 4/1982 | Hacker et al. | 38/77.6 |
| 4,875,301 | 10/1989 | Adams | 223/70 X |
| 5,189,726 | 2/1993 | Pan | 392/401 |
| 5,307,440 | 4/1994 | Carretto | 38/77.6 X |
| 5,315,773 | 5/1994 | Iwami et al. | 38/107 X |

FOREIGN PATENT DOCUMENTS

| | | | |
|---|---|---|---|
| 2829659 | 1/1980 | Germany | 38/77.3 |

*Primary Examiner*—Ismael Izaguirre
*Attorney, Agent, or Firm*—Richard C. Litman

[57] ABSTRACT

A portable garment finishing apparatus of the present invention comprises a water reservoir, a water conversion device, and a conventional steam heated iron. The present apparatus is designed to operate from a single 115 v power source, such as an ordinary wall outlet. Using a water-level probe in connection with a circuit board having a relay switch, a pump is regulated in its supply of water from the reservoir to the steam chamber in the conversion device. Water continuously is converted to steam and constantly released to the iron where it maintains the iron temperature and may be released onto a garment for finishing. The steam returns to the conversion device where it condenses in a steam trap valve for subsequent return to the reservoir, where it may be recycled.

20 Claims, 3 Drawing Sheets

PORTABLE GARMENT FINISHING APPLIANCE

BACKGROUND OF THE INVENTION

1. Field of the Invention

The present invention relates to steam irons for use on apparel and more specifically to a portable steam iron for use in finishing the appearance of apparel. Even more specifically, the present invention relates to a portable, steam heated iron with means for recycling condensation.

2. Description of the Prior Art

The garment industry has long been using steam heated irons coupled via a conduit to a boiler that generates steam. Typical commercial systems utilize a large boiler for producing and supplying a constant source of steam to a number of hand-held irons. It is more practical and simpler to utilize a smaller boiler coupled to a single steam heated iron; however, such smaller systems suffer the same difficulties that hinder the larger commercial systems. The primary problem is the disposal of the condensed water that tends to collect inside the iron.

U.S. Pat. No. 3,414,993, which issued to Kiyoshi Naomoto on Dec. 10, 1968, discloses a steam heated iron that uses the pressure exerted by incoming steam to force condensate out of the steam chamber. One problem with such a discharge system is that condensation may only be removed while steam enters the steam chamber, as controlled by the operator. Other steam heated irons provide discharge only for waste steam. Such systems are those disclosed in U.S. Pat. No. 1,625,535, which issued to Adolph Graf on Apr. 19, 1924; U.S. Pat. No. 1,629,553, which issued to Lester Swenson on May 24, 1927; and U.S. Pat. No. 1,660,396, which issued to Joseph A. Revill on Feb. 28, 1928.

Rather than discharge or recycle the condensation, the prior art typically has relied upon an extra heating element in the iron to ensure nearly complete evaporation of the condensation. U.S. Pat. No. 4,322,900, which issued to Kurt Hacker et al. on Apr. 6, 1982, discloses a steam supplied commercial iron that contains a heating element in its sole to dispose of condensation. One problem with steam-fed, electrically heated irons is that two heating elements are necessary. A first heating element located in the steam generator is responsible for initially vaporizing the water, and then a second heating element in the iron re-vaporizes the condensation. Such irons are unnecessarily wasteful because of the need to operate two such heating elements. Furthermore, many such irons may require higher voltage circuits, i.e., 220 volts, for their operation. In addition, many electrically heated irons can only operate using distilled water because tap water will leave mineral deposits in the iron or stain clothing.

Another problem with steam-fed, electrically heated irons is that the condensation cannot always completely be removed. U.S. Pat. No. 2,160,421, which issued to Julius K. Sebo on May 30, 1939, addresses this concern by providing such an iron with a condensation discharge that operates through gravity when the iron is placed on its end.

Other relevant steam heated irons include those disclosed in U.S. Pat. No. 3,436,852, which issued to B. J. Stansbury on Apr. 8, 1969; U.S. Pat. No. 3,823,497, which issued to Alvin I. Solomon on Jul. 16, 1974; and U.S. Pat. No. 5,189,726, which issued to Costanzo Pan on Feb. 23, 1993.

The device disclosed in the Stansbury '852 patent teaches the use of a portable steam generator with an accompanying steam heated iron having thereon the control mechanism for operation of the device. The device, however, lacks any means for recycling or reducing the condensation that is inherent in any steam heated iron.

The device disclosed in the Solomon '497 patent utilizes an electrically heated boiler (water source) that supplies steam to an iron upon manipulation of a micro-switch by the operator. The micro-switch simultaneously actuates two solenoid valves, one regulating the outflow of steam to the iron and the other regulating the inflow of additional water into the boiler. The '497 device recirculates water displaced from the boiler during the heating phase, but such recirculation occurs prior to the steam reaching the iron.

The device disclosed in the Pan '726 patent utilizes a pair of magnetic flow control switches, the first of which governs the flow of water from the reservoir into the boiler and the second of which governs operation of the device to ensure that the apparatus cannot function absent a sufficient reservoir supply. The second magnetic flow control switch effects a solenoid valve that cuts off the flow of steam to the iron and simultaneously sends a visual signal to the operator.

None of the above inventions and patents, taken either singly or in combination, is seen to describe the instant invention as claimed.

SUMMARY OF THE INVENTION

A portable garment finishing apparatus of the present invention is intended to operate from a single 115 v power source, which allows the apparatus to be used in both commercial and home environments. The apparatus has three distinct components: a reservoir for holding tap water, an electrically powered water conversion device, and a conventional steam heated iron having a steam release valve.

The steam generating device has a double-pole switch that energizes the electrical circuitry. A thermostat regulates the current supplied to a heating element in a steam chamber, and a circuit board with an isolation transformer and a relay switch regulates the current supplied to a solenoid-type pump. The relay switch is actuated by a probe that alternately becomes grounded with changes of the water level inside the steam chamber. A shut-off delay mechanism provided on the circuit board limits the duration of the pumping cycle. Thus, as the water level in the steam chamber changes, the pump is alternately turned on and off to provide the appropriate amount of water to the steam chamber.

With an intermittent supply of fresh water to the steam chamber, the steam heated iron receives a constant supply of steam for heating the iron and for release onto garments. Steam and water return from the iron back into the water conversion device, where the steam is recycled back into the water reservoir. The steam and condensation return to a normally closed steam trap valve. While the temperature of the steam and condensation mixture remains above the critical temperature of approximately 188° F. (87° C.), the trap valve remains closed to collect steam and condensation. When the temperature in the steam trap valve reaches the critical temperature, the valve opens, releasing its contents into a conduit that delivers the condensation to the reservoir. Since the steam supply system is closed, the opening of the trap valve creates a vacuum in the region between the trap valve and the iron. This vacuum draws steam and condensation from the line into the trap valve for later return to the reservoir. In this way, the water used to heat the iron is recycled for later use.

To prevent operation of the garment finishing apparatus while the reservoir is empty, a fail-safe mechanism is provided on the circuit board. If the relay switch does not open within one minute following its initial closure, then the circuit board causes a reset switch to open. The opening of the reset switch causes the pump to shut down, however, after refilling the reservoir an operator may restart the apparatus by depressing a reset button to close the reset switch. Priming means are also provided to assist an operator in restarting the pump.

Accordingly, it is a principal object of the invention to provide a portable garment finishing apparatus that utilizes an entirely steam heated iron.

It is another object of the invention to provide a portable garment finishing apparatus that utilizes a single 115 v power supply.

It is a further object of the invention to provide a portable garment finishing apparatus that recycles water for later use.

Yet another object of the invention is to provide a portable garment finishing apparatus that may utilize tap water rather than distilled water.

Still another object of the invention is to provide a portable garment finishing apparatus with safety features to prevent the apparatus from overheating.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
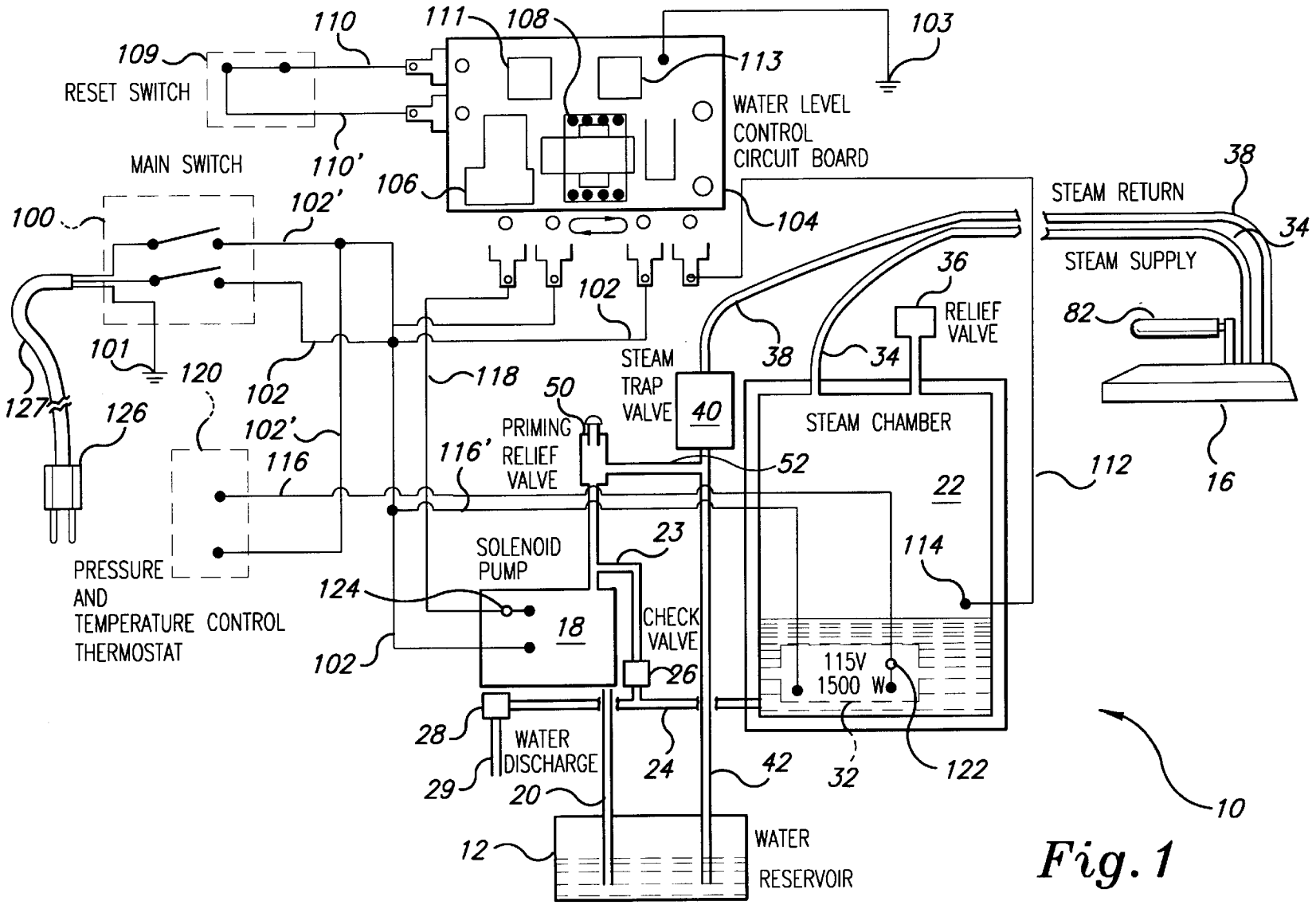
FIG. 1 is a schematic diagram showing the relationship between the electrical system and the components of the portable garment finishing apparatus of the present invention.

Referring to the drawings by numerals of reference, and first to FIG. 1, 10 denotes generally a portable garment finishing apparatus of the present invention. The garment finishing apparatus 10 comprises three separate components, which include the reservoir 12, the portable water conversion device 14, and the steam heated iron 16. The water conversion device 14 conveniently is contained within housing 17, which is portable by its handle 74.

The water circulation process involves all three components, which function in three well defined systems. First, the water transport system moves water from the reservoir 12 to the steam generating system of conversion device 14, which vaporizes the water into steam. The pressure from the steam generating system forces the steam to travel to iron 16, where the steam heats the iron and may be dispersed from the iron to the apparel. Then the return steam and condensation are drawn by vacuum back into the water conversion device 14, where it is introduced to the water recycling system for condensation of the steam. Once the steam condenses into a liquid state and cools, the water recycling system returns the water to reservoir 12.

The water transport system involves reservoir 12 and a solenoid-type pump 18. The reservoir 12 connects to pump 18 via an intake conduit 20. When energized, pump 18 draws water from reservoir 12 through conduit 20, and directs the water to steam chamber 22 via pump output conduit 23 and the steam chamber supply/discharge conduit 24. The junction between conduit 23 and conduit 24 is a typical T-connection, with a check valve 26 interposed between conduit 23 and conduit 24. Check valve 26 allows water to flow only in the direction from pump 18 to steam chamber 22, thereby preventing water from flowing through conduit 23 when conduit 24 is used to discharge water from the steam chamber 22.

Conduit 24 enters steam chamber 22 adjacent its bottom so that when water is discharged from the steam chamber, the water may flow from steam chamber 22 by force of gravity. To control the discharge of water, a discharge valve 28 is provided on the side of the T-connection opposite steam chamber 22. To discharge the water from steam chamber 22, the handle 27, located on the front face 15 of water conversion device 14 (shown at FIG. 3), is rotated to open discharge valve 28. The opened discharge valve 28 allows any waste water to flow through discharge conduit 29 to a location other than reservoir 12, such as a floor drain or the like.

In the event pump 18 needs priming, i.e., following a shut-down of the water conversion device 14, conduit 23 is provided with a priming relief valve 50. Relief valve 50 communicates with air conduit 52, which connects at its other end to water recycle conduit 42. Actual priming of pump 18, as discussed hereinafter, may be accomplished by pressing the priming button 54, which extends upwardly from the top 75 of housing 17 (shown at FIGS. 2 and 3).

The steam generating system primarily involves a seamless steel steam chamber 22, which holds approximately six ounces (179 ml.) of water when full, and a 1500 Watt heating element 32 located therein. Where the heating element 32 enters steam chamber 22 is a high temperature seal to prevent leakage from the steam chamber. Steam chamber 22 has a layer of insulation I that serves to protect the other components of water conversion device 14 from the high temperatures of the steam chamber, i.e., approximately 330°–340° F. (165°–171° C.). Steam chamber 22 also has a high temperature seal at the junction where each conduit enters chamber 22. At its upper end, steam chamber 22 has a sealed coupling 44 that passes through the top 75 of housing 17 (for water conversion device 14). Steam supply line 34 threadably connects to coupling 44 at one end, and connects to iron 16 at its other end.

When heating element 32 vaporizes water, the pressure inside steam chamber 22 forces the steam upwardly into the steam supply line 34, which feeds the steam heated iron 16. Steam chamber 22 also is equipped with a relief valve 36, which is set to open at a predetermined pressure level in the event the pressure becomes too high inside steam chamber 22. Once steam chamber 22 begins producing steam, it will continue to do so until the device is turned off, either manually or when reservoir 12 becomes dry. Thus, iron 16 receives a constant supply of hot steam to maintain the iron temperature within a range of approximately 250°–300° F. (121°–149° C.).

Although iron 16 receives a constant supply of steam from steam chamber 22, not all of the steam is used for finishing an article of clothing. Instead, much of the steam serves to maintain the above-indicated operating temperature of iron 16. To heat iron 16 using solely the steam coursing through the iron necessarily requires that the steam cool. Therefore, some of the steam remains as vapor and some of it begins to condense.

The water recycling system primarily involves a steam trap valve 40, which is responsible for condensing the steam and returning the condensed water to reservoir 12. At its upper end, steam trap valve 40 has a sealed coupling 46 that passes through the top 75 of water conversion device 14. Steam return line 38 threadably connects to coupling 46 at one end, and connects to iron 16 at its other end. From iron 16, the liquid condensate and cooling steam are drawn through the steam return line 38 by the transient vacuum pressure created by the cyclical opening and closing of steam trap valve 40.

The steam trap valve 40 operates at a critical temperature of approximately 188° F. (87° C.). Steam and condensation collect in the steam trap valve 40 until the temperature falls to approximately 188° F. (87° C.) at the steam trap valve, at which point the valve opens and discharges the liquid contents into the water recycle conduit 42 and subsequently the reservoir 12. Once steam trap valve 40 discharges all of its contents, the valve 40 closes and resumes its collection of steam and condensation from steam return line 38.

The garment finishing apparatus 10 operates on a single 115 v power supply, which energizes the water conversion device 14 when an operator closes main switch 100. Main switch 100 is a double-pole switch, grounded at 101, that supplies current through electrical lines 102,102'. Electrical lines 102,102' supply current to the circuit board 104, which functions primarily to control operation of the water supply system. Circuit board 104, grounded at 103, contains a relay switch 106 and an isolation transformer 108. Transformer 108 steps-down the voltage supplied to relay switch 106 on circuit board 104.

Electrical line 102 supplies current directly to pump 18 from main switch 100, however, pump 18 is energized and de-energized only upon actuation of relay switch 106. Relay switch 106 and pump 18 are connected along electrical line 118. Thus, a potential is provided across pump 18 only when line 118 delivers current to pump 18, which occurs while relay switch 106 remains closed.

FIG. 1 illustrates the stage of the operation cycle where relay switch 106 already has closed to energize pump 18, and pump 18 has begun supplying water to steam chamber 22. Electrical line 112 connects at one end to relay switch 106 and at its other end to water-level probe 114. When the water level reaches probe 114, the probe provides a ground potential to line 112. The ground potential causes a shut-off delay mechanism 111 on circuit board 104 to begin a six second countdown before opening relay switch 106. When relay switch 106 opens, breaking the connection to electrical line 118, the electric potential at pump 18 is lost and the pump de-energizes to cease the supply of water to steam chamber 22. By providing a delay between the grounding of line 112 and the shutting-off of pump 18, the pump is able to provide approximately one ounce (29.8 ml.) of water to steam chamber 22 and thereby raise the water level above the height of probe 114.

As heating element 32 continues to vaporize water in steam chamber 22, the water level falls. When the water level falls below probe 114, the probe and electrical line 112 no longer are grounded. The loss of ground potential along electrical line 112 causes relay switch 106 to close, which resumes the supply of current through electrical line 118 to pump 18. Pump 18 continues to supply water until relay switch 106 opens to cease the supply of current through electrical line 118, which occurs according to the previously described time delay.

The above-described cycle of energizing and de-energizing pump 18 to provide an intermittent supply of water to steam chamber 22 continues for as long as the garment finishing apparatus 10 is turned-on and the water supply in reservoir 12 remains. In the event reservoir 12 runs dry, the garment finishing apparatus has a fail-safe mechanism 113 provided on circuit board 104. If relay switch 106 remains closed (and supplying power to pump 18) for one minute following its initial closing, as described above, the fail-safe mechanism 113 on circuit board 104 opens the electrical connection to pump 18. Thus, the fail-safe mechanism 113 prevents operation of pump 18 while reservoir 12 is empty. To re-start the steam conversion device 14 by closing the electrical connection to pump 18, an operator must open, then close a reset switch 109. The normally closed reset switch 109 is connected along electrical lines 110,110' to the circuit board 104. Reset switch 109 is provided with a button 70, exposed through the top 75 of housing 17 (shown in FIGS. 2 and 3), that may be used to open and close reset switch 109. Although not shown, reset switch 109 may also be provided with a small incandescent light that illuminates button 70 when circuit board 104 opens the connection to pump 18. If provided, such a light may assist an operator in addressing the cause of the shut-down.

Control over heating element 32 is provided by a pressure and temperature control thermostat 120. Thermostat 120 is connected to electrical line 102'. Heating element 32 and the thermostat 120 are connected via electrical line 116, and electrical line 116' connects heating element 32 to electrical line 102. A potential is provided across heating element 32 while thermostat 120 maintains the connection between electrical lines 102' and 116. When heating element 32 elevates the temperature of steam chamber 22 beyond the temperature setting of thermostat 120, thermostat 120 opens the connection between electrical lines 102' and 116 to remove the potential across heating element 32. This causes heating element 32 temporarily to shut-off due to the loss of power. Shortly thereafter, when the temperature of steam chamber 22 falls below the temperature setting of thermostat 120, the thermostat closes the connection between lines 102' and 116 and causes heating element 32 to reheat.

Both heating element 32 and pump 18 are provided with internal safety shut-off thermostats 122 and 124, respectively. The shut-off thermostats 122 and 124, respectively, will cause the water conversion device 14 to shut down in the event either heating element 32 or pump 18 overheats during use.

In use, the portable garment finishing apparatus 10 will be carried by its handle 74 and brought adjacent the work surface containing garments to be pressed. The reservoir 12 should first be filled with tap water. Next, the grounded plug 126 on power cord 127 (of water conversion device 14) should be plugged into a standard 115 v wall outlet. Before turning on water conversion device 14, steam supply line 34 and steam return line 38 should be connected to the appropriate couplings 44 and 46, respectively, on water conversion device 14 and the appropriate couplings 78 and 80, respectively, on iron 16.

Figure 2:
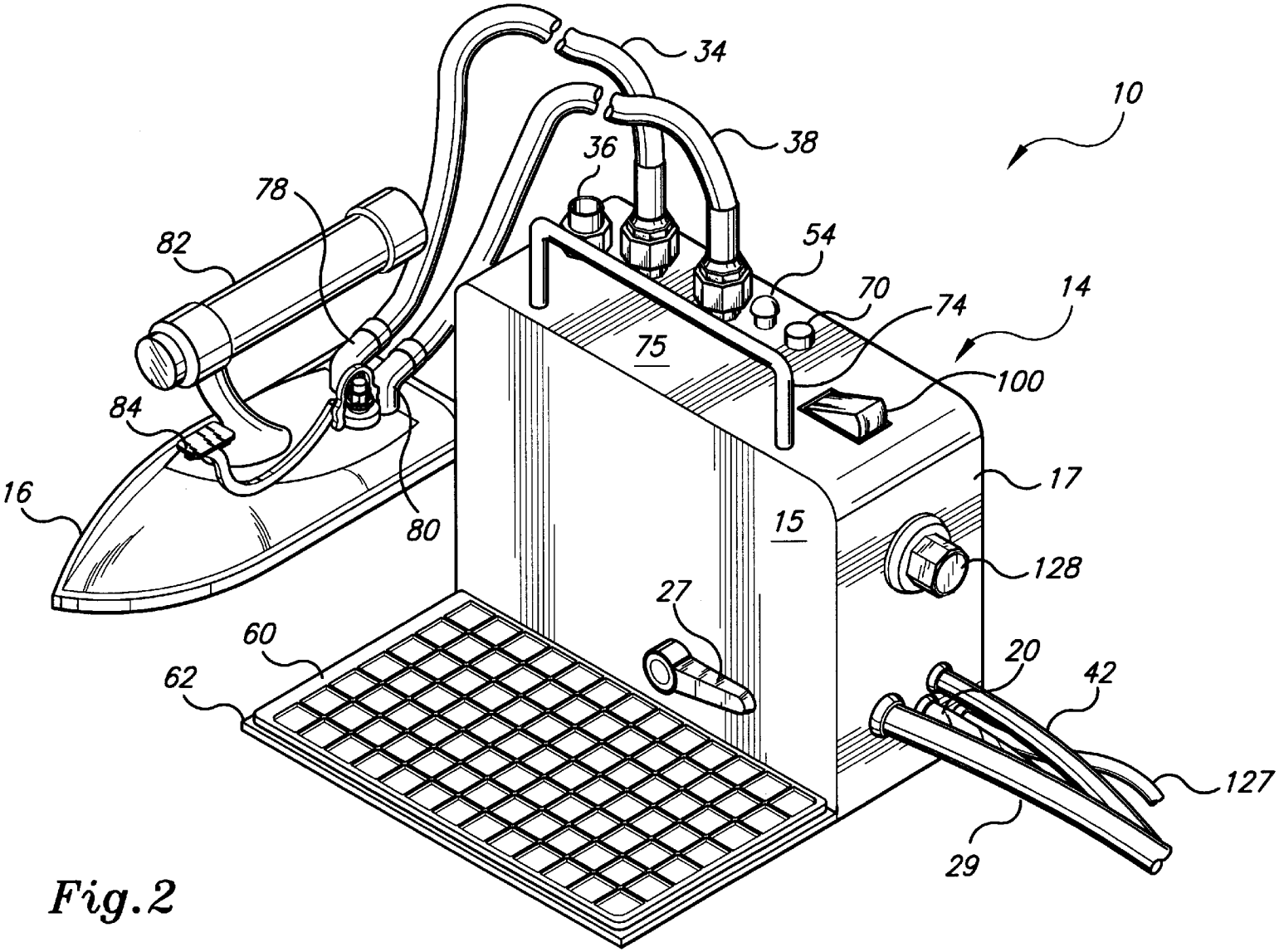
FIG. 2 is an environmental view of the portable apparel finishing apparatus, showing its steam generating device and the accompanying steam heated iron.
Figure 3:
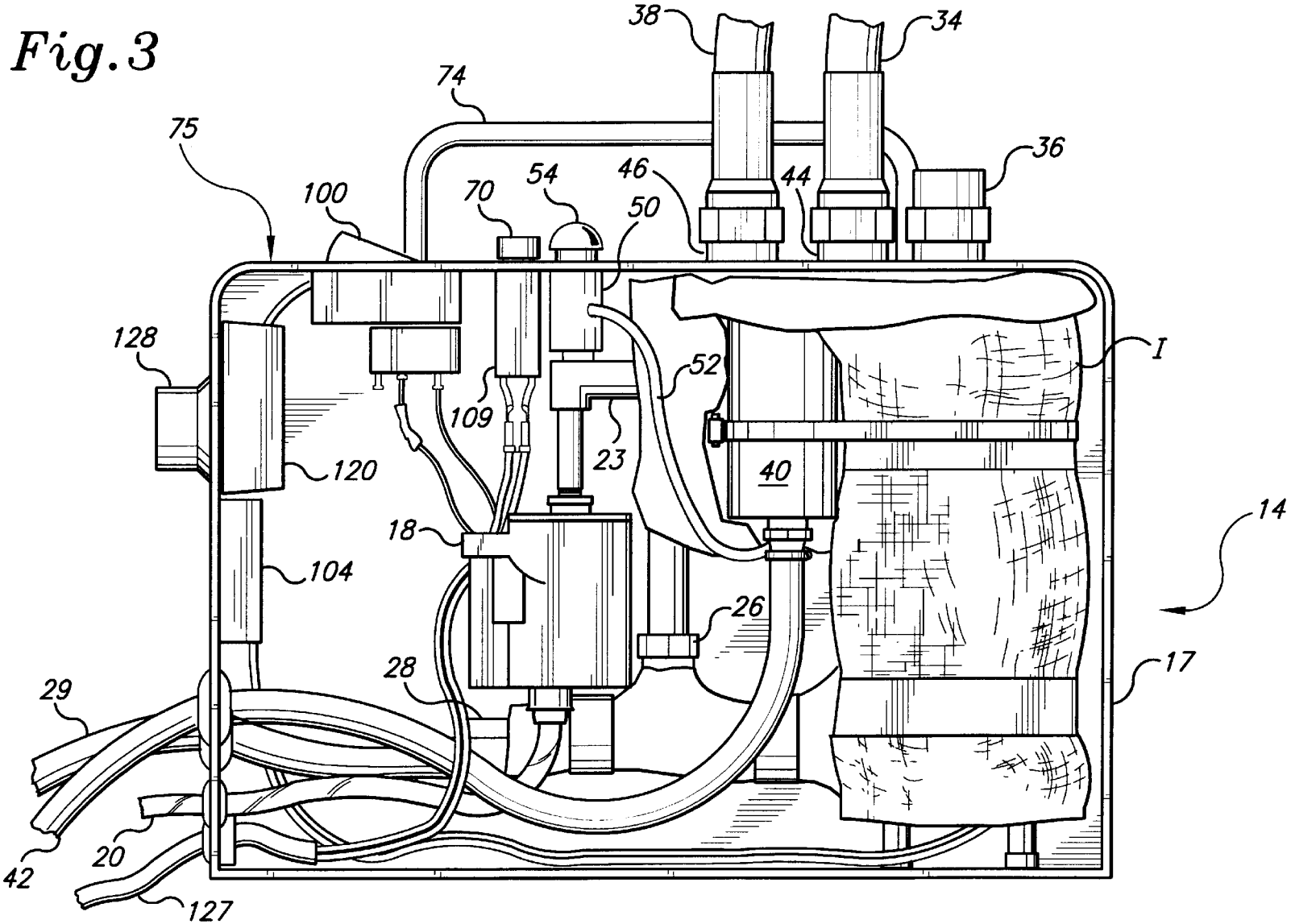
FIG. 3 is a front elevational view of the steam generating device of the present invention, with the cover removed to expose the internal components, and the steam chamber shown by the ghost lines to the right side of the diagram.

Referring now to FIGS. 2 and 3, the main switch 100, exposed through the top 75 of housing 17, may be turned on to begin the water conversion process. The operator also may wish to select a desirable temperature setting by manually rotating thermostat control knob 128 until an appropriate setting is indicated, i.e., settings "one" through "ten." Assuming the water level in steam chamber 22 is too low, pump 18 initially is energized through relay switch 106 to pump water from reservoir 12 into steam chamber 22 until the steam chamber is full. At the same time, heating element 32 also will be energized to begin heating water for its conversion to steam.

At the beginning of operation the garment finishing apparatus 10 will be cool and so, too, will steam trap valve 40 therein. Because steam trap valve 40 is cool, and thus below the critical temperature of approximately 188° F. (87° C.), the valve 40 will be in the open position. As steam production begins in steam chamber 22, steam will travel to the initially cool iron 16. The steam passing into iron 16 will cool as it heats the iron. The return steam and condensation will flow through the initially open steam trap valve 40 and return to reservoir 12. Eventually iron 16 will heat up and the return steam and condensation will reach higher temperatures. With the temperature of the return steam elevating, the steam trap valve 40 will reach a temperature above approximately 188° F. (87° C.), at which point the valve closes.

With the constant supply of steam coursing through iron 16, the iron will operate at a temperature of approximately 250°–300° F. (121°–149° C.). When the water level in steam chamber 22 falls below probe 114, the lost ground potential causes relay 106 to close, which energizes pump 18. After probe 114 provides a ground potential to circuit board 104, the six second delay time before opening relay switch 106 allows pump 18 to refill steam chamber 22. With the circuit board 104 controlling operation of pump 18, the pump will introduce approximately one ounce (29.8 ml.) of water into the steam chamber 22. Because only one ounce (29.8 ml.) of water from the reservoir mixes with the five ounces (149 ml.) of heated water already in chamber 22, the heating element 32 will continue to produce steam without any delay or down-time.

During the repetitive cycles of pump 18 operation, which depletes the reservoir 12 of its water supply, the trap valve 40 will continue to collect return steam and recycle condensate into the reservoir 12. In this fashion, the water conversion device 14 nearly continually replenishes the resource of water necessary to operate the garment finishing apparatus 10. The cycle cannot continue indefinitely, of course, because steam is lost at iron 16 where it is discharged to the apparel during finishing. This cycle continues, however, until the water conversion device 14 is turned off or until the reservoir 12 empties.

If reservoir 12 empties, a fail-safe mechanism 113 on circuit board 104 opens the electrical connection to pump 18 following one minute of pump operation without the closing of relay switch 106 (as previously described). This results in the shutting-down of pump 18 to prevent operation of the garment finishing apparatus 10 absent a water supply. To restart operation of the garment finishing apparatus 10, an operator must first fill reservoir 12. Once reservoir 12 is filled, an operator may restart garment finishing apparatus 10 by twice depressing button 70 to open, then close, reset switch 109. Next, an operator should prime pump 18 within one minute to prevent another shut-down. Because of the air pressure accumulated in conduit 23 and pump 18 during the one minute prior to shut-down and when the pump first begins to operate after resetting switch 109, pump 18 will not be able to draw water from reservoir 12 unless it is primed. To accomplish the priming of pump 18, an operator must depress button 54 (shown at FIGS. 2 and 3) to open the priming relief valve 50. Once opened, valve 50 allows air to escape through air conduit 52, which connects at its other end to water recycle conduit 42. Thus, during priming, air exits the system through water recycle conduit 42 to allow pump 18 to draw water from reservoir 12. Once pump 18 forces the air from the system, button 54 may be released to allow water to flow from pump 18 to steam chamber 22.

Steam iron 16 has a conventional construction with couplings 78 and 80 for receiving steam supply line 34 and steam return line 38, respectively. Adjacent the handle 82 on iron 16 is a trigger 84 that operates a valve to allow the iron 16 to disperse steam to the garment. The operator may effect the operating temperature of the iron 16 by manipulating thermostat control knob 128 located on housing 17. When the temperature within the steam chamber 22 breaches the thermostat setting, the thermostat 110 will cease supplying current to heating element 32, thereby cooling both the temperature inside the steam chamber 22 and the temperature of iron 16.

Steam conversion device 14 also contains a rest pad 60 mounted on a support tray 62 that extends outwardly from the base of housing 17. Rest pad 60 is formed of a foam insulating material with a burn resistance up to approximately 600° F. (316° C.). Because iron 16 is a conventional steam heated iron and it does not have an upright rest position, the steam conversion device 14 is provided with such a rest pad 60 to provide an operator with a safe place to set down iron 16 without any risk of causing harm or damage. For example, an operator may require both hands to align a garment for pressing, or an operator may wish to refill reservoir 12. Also, it will be necessary for an operator to place the hot iron 16 somewhere to cool when the device 14 finally is shut-off at the end of the day.

It is to be understood that the present invention is not limited to the sole embodiment described above, but encompasses any and all embodiments within the scope of the following claims.

I claim:

1. A portable garment finishing apparatus for operation from a power source, the apparatus comprising:

a water reservoir;

a housing containing a water transport system and a steam generating system, there further being a main switch on said housing operable to connect said water transport system and said steam generating system to the power source; and a steam using device in communication with said steam generating system, said steam using device being heated by steam received from said steam generating system;

said steam generating system having a steam chamber, an inlet in communication with said water transport system, an outlet in communication with said steam using device, and a heating element in said steam chamber, said heating element receiving the electrical current upon operation of said main switch;

said water transport system having a pump with an inlet in communication with said reservoir and an outlet in communication with said inlet of said steam generating system, and pump control means for regulating the electrical current to said pump relative to said steam generating system; and said housing also containing a water recycling system having an inlet in communication with said steam using device and an outlet in communication with said reservoir, said water recycling system collecting steam and water from said steam using device and returning water to said reservoir.

2. The portable garment finishing apparatus according to claim 1, said water recycling system comprising a steam trap having an inlet for receiving steam from said steam using device, an outlet for delivering water to said reservoir, and a valve intermediate said inlet and outlet, said valve reciprocating between an open position and a closed position when the temperature of said steam trap crosses a predetermined threshold temperature.

3. The portable garment finishing apparatus according to claim 2, wherein said valve remains in said open position while the temperature of said steam trap is below the predetermined threshold temperature, and said valve remains in said closed position while the temperature of said steam trap is above the predetermined threshold temperature.

4. The portable garment finishing apparatus according to claim 3, wherein said threshold temperature is approximately 188° Fahrenheit.

5. The portable garment finishing apparatus according to claim 1, wherein said steam generating system further includes a thermostat intervening between the power source and said heating element to provide temperature control in said steam chamber.

6. The portable garment finishing apparatus according to claim 1, wherein said water transport system further includes water discharge means for draining said steam chamber.

7. The portable garment finishing apparatus according to claim 6, said water discharge means comprising:

a check valve interposed between said outlet of said pump and said inlet of said steam generating system, said check valve allowing the flow of water only from said pump to said steam generating system;

a three-way plumbing joint interposed between said check valve and said inlet of said steam generating system, said plumbing joint having one of its three connections communicating with a discharge valve; and said discharge valve having a handle operable to reciprocate said discharge valve between a closed position where water may flow into said steam generating system, and an open position where water may flow from said steam generating system through said discharge valve into a discharge conduit.

8. The portable garment finishing apparatus according to claim 1, wherein said pump control means comprises:

a probe in said steam chamber; and a circuit board having a shut-off delay mechanism and a relay switch, said relay switch having a connection to said probe, a connection to the power source, and a connection to said pump, and said relay switch being reciprocable between an open position and a closed position;

said relay switch shifting into said closed position to supply the electrical current from the power source to said pump when the water level in said steam chamber falls below said probe and said probe loses its ground potential; and said relay switch being shifted into said open position by said shut-off delay mechanism to cease the electrical current from the power source to said pump after a fixed duration following the rising of the water level in said steam chamber above said probe and said probe acquiring a ground potential.

9. The portable garment finishing apparatus according to claim 8, said pump control means further comprising safety shut-off means for preventing operation of the pump when said reservoir is empty.

10. The portable garment finishing apparatus according to claim 9, wherein said safety shut-off means comprises:

a fail-safe mechanism on said circuit board, said fail-safe mechanism being electrically connected between the power source and said pump, said fail-safe mechanism opening the circuit between said power source and said pump to prevent operation of said pump when said relay switch remains closed for a fixed duration following the closure of said relay switch;

a reset switch electrically connected to said fail-safe mechanism on said circuit board, said reset switch being reciprocable between an open position and a closed position with said reset switch normally being in said closed position, and said reset switch closing the circuit between the power source and said pump to allow for operation of said pump upon said reset switch being operatively shifted to said open position then said closed position; and means on said housing operable to shift said reset switch from said open position to said closed position, and from said closed position to said open position.

11. A water conversion apparatus for use with a separate steam iron and a separate water reservoir, and for operation from a single power source, the apparatus comprising:

a steam generator having a heating element for converting water into steam, an inlet for receiving water to be converted into steam, and an outlet for delivering steam to the iron;

a pump hydraulically connected to the reservoir and said inlet on said steam generator for drawing water from the reservoir and delivering water to said inlet of said steam generator;

pump control means connected to the power source for regulating operation of said pump and the delivery of water to said steam generator; and steam recycling means for recovering steam from the iron and delivering condensed water to the reservoir.

12. The water conversion apparatus according to claim 11, wherein said pump control means comprises:

a probe in said steam chamber; and a circuit board having a shut-off delay mechanism and a relay switch, said relay switch having a connection to said probe, a connection to the power source, and a connection to said pump, and said relay switch being reciprocable between an open position and a closed position;

said relay switch shifting into said closed position to supply the electrical current from the power source to said pump when the water level in said steam chamber falls below said probe and said probe loses its ground potential; and said relay switch being shifted into said open position by said shut-off delay mechanism to cease the electrical current from the power source to said pump after a fixed duration following the rising of the water level in said steam chamber above said probe and said probe acquiring a ground potential.

13. The water conversion apparatus according to claim 12, said pump control means further comprising safety shut-off means for preventing operation of the pump when the reservoir is empty.

14. The water conversion apparatus according to claim 13, wherein said safety shut-off means comprises:

a fail-safe mechanism on said circuit board, said fail-safe mechanism being electrically connected between the power source and said pump, said fail-safe mechanism opening the circuit between said power source and said pump to prevent operation of said pump when said relay switch remains closed for a fixed duration following the closure of said relay switch;

a reset switch electrically connected to said fail-safe mechanism on said circuit board, said reset switch being reciprocable between an open position and a closed position with said reset switch normally being in said closed position, and said reset switch closing the circuit between the power source and said pump to allow for operation of said pump upon said reset switch being operatively shifted to said open position then said closed position; and means on said housing operable to shift said reset switch from said open position to said closed position, and from said closed position to said open position.

15. The water conversion apparatus according to claim 11, wherein said steam recycling means comprises a steam trap having an inlet for receiving steam from the steam iron and an outlet for delivering water to the reservoir, and a valve between said inlet and said outlet, said valve reciprocating between an open position and a closed position when the temperature of said steam trap crosses a predetermined threshold temperature.

16. The water conversion apparatus according to claim 15, wherein said valve remains in said open position while the temperature of said steam trap is below the predetermined threshold temperature, and said valve remains in said closed position while the temperature of said steam trap is above the predetermined threshold temperature.

17. The water conversion apparatus according to claim 16, wherein said threshold temperature is approximately 188° Fahrenheit.

18. The water conversion apparatus according to claim 11, wherein the steam generator further comprises a thermostat intervening between the power source and said heating element in said steam generator, said thermostat regulating the temperature in said steam generator.

19. The water conversion device according to claim 11, further comprising water discharge means for draining said steam generator.

20. The water conversion device according to claim 19, said water discharge means comprising:

a check valve interposed between said pump and said inlet of said steam generator, said check valve allowing the flow of water only in the direction from said pump to said steam generator; and a three-way plumbing joint interposed between said check valve and said inlet of said steam generating system, said plumbing joint having one of its three connections communicating with a discharge valve; and said discharge valve having a handle operable to reciprocate said discharge valve between a closed position where water may flow into said steam generating system, and an open position where water may flow from said steam generating system through said discharge valve into a discharge conduit.

* * * * *